US010407281B2

(12) United States Patent
Passmann et al.

(10) Patent No.: US 10,407,281 B2
(45) Date of Patent: Sep. 10, 2019

(54) CRANE, IN PARTICULAR BRIDGE CRANE OR GANTRY CRANE, HAVING AT LEAST ONE CRANE GIRDER

(71) Applicant: Konecranes Global Corporation, Hyvinkää (FI)

(72) Inventors: Christoph Passmann, Dortmund (DE); Richard Kreisner, Ennepetal (DE); Thomas Schlierbach-Knobloch, Herdecke (DE); Stefan Noll, Burscheid (DE)

(73) Assignee: Konecranes Global Corporation, Hyvinkää (FI)

( * ) Notice: Subject to any disclaimer, the term of this patent is extended or adjusted under 35 U.S.C. 154(b) by 179 days.

(21) Appl. No.: 15/547,651

(22) PCT Filed: Feb. 5, 2016

(86) PCT No.: PCT/EP2016/052565
§ 371 (c)(1),
(2) Date: Jul. 31, 2017

(87) PCT Pub. No.: WO2016/124772
PCT Pub. Date: Aug. 11, 2016

(65) Prior Publication Data

US 2018/0029848 A1 Feb. 1, 2018

(30) Foreign Application Priority Data

Feb. 6, 2015 (DE) ..... 10 2015 101 756

(51) Int. Cl.
*B66C 6/00* (2006.01)
*B66C 7/00* (2006.01)
(Continued)

(52) U.S. Cl.
CPC ..... *B66C 6/00* (2013.01); *B66C 7/00* (2013.01); *B66C 19/00* (2013.01); *B66C 17/00* (2013.01);
(Continued)

(58) Field of Classification Search
CPC .. B66C 6/00; B66C 7/00; B66C 19/00; B66C 17/00; B66C 2700/012; E04C 3/09
See application file for complete search history.

(56) References Cited

U.S. PATENT DOCUMENTS 327,360 A * 9/1885 Vanes ..... E04C 3/02 52/695
1,656,810 A * 1/1928 Arnstein ..... B64C 1/065 52/634
(Continued)

FOREIGN PATENT DOCUMENTS

CH 273005 A 1/1951
DE 1907455 A1 10/1969
(Continued)

OTHER PUBLICATIONS

Commonly assigned co-pending U.S. Appl. No. 15/547,667, filed Jul. 31, 2017, entitled Crane, in Particular, Bridge Crane or Gantry Crane, Having At Least One Crane Girder.
(Continued)

*Primary Examiner* — Michael E Gallion
(74) *Attorney, Agent, or Firm* — Gardner, Linn, Burkhart & Ondersma LLP

(57) ABSTRACT

A crane, such as a bridge crane or gantry crane, having at least one horizontally extending crane girder, which is designed as a lattice girder having a plurality of braces and on which a crane trolley having a lifting device can be moved. At least some of the braces are planiform, and each of the planiform braces has a flat main surface, which
(Continued)

extends transversely to a longitudinal direction of the crane girder. On each longitudinal side of the braces, a first cut-out and a second cut-out are provided in the main surfaces. The longitudinal sides of at least some of the planiform braces are free of edge bends at least between the first and second cutouts.

21 Claims, 4 Drawing Sheets

(51) Int. Cl.

| | |
|---|---|
| ***B66C 19/00*** | (2006.01) |
| *B66C 17/00* | (2006.01) |
| *E04C 3/09* | (2006.01) |
| *E04C 3/04* | (2006.01) |

(52) U.S. Cl.
CPC ..... *B66C 2700/012* (2013.01); *E04C 3/09* (2013.01); *E04C 2003/0491* (2013.01)

(56) References Cited

U.S. PATENT DOCUMENTS

| | | | | |
|---|---|---|---|---|
| 2,860,743 | A * | 11/1958 | Cliff | E04C 3/08 403/230 |
| 3,849,961 | A * | 11/1974 | Gwynne | E04C 3/09 52/639 |
| 4,282,619 | A * | 8/1981 | Rooney | E01D 2/04 14/6 |
| 6,634,153 | B1 * | 10/2003 | Peterson | E04C 3/08 52/695 |
| 7,503,460 | B1 * | 3/2009 | Petricio Yaksic | B66C 5/02 104/126 |
| 8,037,658 | B2 * | 10/2011 | Kundel, Sr. | B66C 7/08 52/283 |
| 8,517,192 | B2 | 8/2013 | Franzen et al. | |
| 9,067,765 | B2 | 6/2015 | Spies et al. | |
| 9,096,413 | B2 | 8/2015 | Gryzan et al. | |
| 9,139,374 | B2 | 9/2015 | Bhosale et al. | |
| 9,540,216 | B2 | 1/2017 | Paßmann et al. | |
| 9,751,730 | B2 * | 9/2017 | Paβmann | B66C 19/00 |
| 9,790,060 | B2 * | 10/2017 | Paβmann | B66C 19/00 |
| 9,796,565 | B2 * | 10/2017 | Paβmann | B66C 17/00 |
| 2011/0247993 | A1 * | 10/2011 | Chernyak | B66C 6/00 212/324 |
| 2014/0291269 | A1 | 10/2014 | Passmann et al. | |
| 2015/0259179 | A1 * | 9/2015 | Paßmann | B66C 19/00 212/71 |
| 2015/0266703 | A1 * | 9/2015 | Paßmann | B66C 19/00 212/71 |
| 2016/0264384 | A1 * | 9/2016 | Roodenburg | B66C 23/70 |
| 2017/0066632 | A1 | 3/2017 | Hegewald | |
| 2017/0144867 | A1 * | 5/2017 | Paßmann | B66C 6/00 |

FOREIGN PATENT DOCUMENTS

| | | | |
|---|---|---|---|
| DE | 3222307 | A1 | 12/1983 |
| DE | 102005021521 | A1 | 11/2006 |
| DE | 102012102808 | A1 | 10/2013 |
| EP | 0420084 | A1 | 4/1991 |

OTHER PUBLICATIONS

Preliminary Report on Patentability of the International Searching Authority in English from corresponding Patent Cooperation Treaty (PCT) Application No. PCT/EP2016/052565, completed May 29, 2017.

International Search Report of the International Searching Authority from corresponding Patent Cooperation Treaty (PCT) Application No. PCT/EP2016/052565, indicated completed on May 9, 2016.

Witten Opinion of the International Searching Authority from corresponding Patent Cooperation Treaty (PCT) Application No. PCT/EP2016/052565, indicated completed on Aug. 11, 2016.

International Preliminary Examination Report from corresponding Patent Cooperation Treaty (PCT) Application No. PCT/EP2016/052565, dated Feb. 14, 2017.

* cited by examiner

CRANE, IN PARTICULAR BRIDGE CRANE OR GANTRY CRANE, HAVING AT LEAST ONE CRANE GIRDER

CROSS REFERENCE TO RELATED APPLICATIONS

The present application claims the priority benefits of International Patent Application No. PCT/EP2016/052565, filed Feb. 5, 2016, and claims benefit of DE 102015101756.3, filed on Feb. 6, 2015, which are incorporated herein by reference.

BACKGROUND OF THE INVENTION

The invention relates to a crane, in particular a bridge crane or gantry crane, having at least one horizontally extending crane girder designed as a lattice girder having a plurality of struts, on which crane girder a crane trolley with a hoist can travel, wherein at least some of the struts have a sheetlike flat design and the flat struts each comprise a planar main surface which extends in each case transversely to a longitudinal direction of the crane girder, wherein on each long side of the struts a first recess and a second recess is provided in the main surfaces.

A crane of this type is known from the German laid-open document DE 10 2012 102 808 A1. In this connection, the struts are disposed in pairs in the shape of a pitched roof and a vertically extending post is provided between the struts of each pair of struts. An upper boom and a lower boom of the crane girder are connected to one another via the struts and the posts. Furthermore, the struts have long sides with bent edges for stiffening purposes. The bent edges of the long sides mean that side surfaces are formed between lower first and upper second recesses and adjoin the main surfaces as so-called anti-buckling means, are bent at approximately a right angle with respect to the main surfaces and are oriented transversely to the longitudinal direction of the crane girder.

In relation thereto, the supporting elements of a lattice construction which extend in an inclined or diagonal manner are generally considered to be struts. In this way the struts of a lattice construction differ from the supporting elements which extend purely vertically and are referred to as posts. Furthermore, the flat struts or planar struts preferably absorb forces in the direction of their longitudinal axis and therefore in the plane of extension of their planar main surface. Flat elements or flat supporting structures of this type are referred to in mechanics as disks, whereas flat elements loaded perpendicularly to their plane of extension or main surface are referred to as plates. Disks and therefore also the present planar struts differ e.g. from bars or bar-like posts and struts in that their thickness dimensions are substantially smaller than the length and width dimensions determining the planar extension of the disk. Consequently, flat struts are also referred to as planar struts or disk struts.

DE 32 22 307 A1 discloses a bridge girder with flat struts which is designed as a lattice girder.

Further lattice girders are known from US 327360 A and DE 1 907 455 A.

SUMMARY OF THE INVENTION

The object of the invention is to provide a crane, in particular a bridge crane or gantry crane, having at least one improved crane girder.

In the case of one embodiment of a crane, in particular a bridge crane or gantry crane, having at least one horizontally extending crane girder designed as a lattice girder having a plurality of struts, on which crane girder a crane trolley with a hoist can travel, wherein at least some of the struts have a sheetlike flat design and the flat struts each comprise a planar main surface which extends in each case transversely to a longitudinal direction of the crane girder, wherein on each long side of the struts a first recess and a second recess is provided in the main surfaces, the at least one crane girder is advantageously improved in that the long sides are formed without bent edges by at least some of the flat struts at least between the first and second recesses. In this way, manufacturing outlay can be further reduced. By means of the round recesses the main surface is narrowed transversely to the longitudinal axis, whereby the struts in these regions each form a type of membrane joint and effect optimised force flow through the struts. While in the case of conventional flat struts troublesome edge-bending or curving of the long sides is required in order to produce side surfaces between the first and second recesses or membrane joints, it is possible to dispense with this in the case of the flat struts without bent edges. In this way, the dimensions, particularly the length and width of the main surfaces extending transversely to the longitudinal direction of the crane girder, can advantageously be freely selected merely by appropriate selection of the thickness of the sheet metal. Furthermore, owing to the omission of structurally unnecessary regions of sheet metal and an associated saving of material, the crane girders produced with the struts in accordance with the invention have a markedly reduced intrinsic weight while retaining optimised bearing capability.

In a further embodiment, provision is made for the long sides to be formed without bent edges over their entire length. In this way, manufacturing outlay can be further reduced.

In a constructionally simple manner, provision is made for the bent edge-free long sides to extend exclusively in a plane of the respective main surface.

The above-mentioned advantages can be enhanced further by forming the long sides of all struts without bent edges. Owing to the fact that for this purpose all struts have also a sheetlike flat design, in comparison with conventional lattice constructions all individually adapted bar-like struts or flat struts with side surfaces which are troublesome to produce can be replaced with unitary flat struts in accordance with the invention. This leads to a considerable manufacturing advantage since each flat strut is produced from a laser-cut sheet of steel without further troublesome manufacturing steps. The use of appropriate laser cutting alone makes it possible for the struts to be of any construction.

In a particularly advantageous manner, provision is also made for at least one first strut and one second strut to form a strut pair and to be disposed in an X shape with respect to one another as seen transversely to the longitudinal direction of the crane girder. In contrast to the known crane girders with lattice construction, the crane girders improved in this manner are characterised in that no posts have to be used in order to ensure the required stability of the crane girder. In this way, the number of parts can consequently be reduced and material can be saved. At the same time, the torsional stiffness can be increased compared to known lattice crane girders. The risk of the flat struts and individual regions of the crane girder buckling can also be reduced by the X-shaped arrangement of the intersecting struts.

In a constructionally simple manner, provision is made that the two struts of each strut pair each comprise a cut-out in one of the long sides and the two struts are fitted together by means of the two cut-outs.

Simple manufacture of the crane is achieved in that the two struts of each strut pair are welded together in the region of the cut-outs.

In an advantageous manner, provision is also made for the cut-outs in the struts of each strut pair to be formed in such a way that the mutually allocated long sides of the struts arranged in an X shape are disposed in a flush arrangement. In this way, a particularly uniform and therefore secure mutual support of the two struts of each strut pair is achieved.

In a constructionally simple embodiment, provision is made for the cut-outs to extend starting from the respective long side in the direction of a longitudinal axis of the struts, preferably in a rectangular shape, in particular as far as the longitudinal axis, and to be disposed preferably in the region of half the strut length.

In a constructionally simple manner, provision is made for at least one first strut and one second strut to form a strut pair and to be disposed in a V shape with respect to one another as seen transversely to the longitudinal direction of the crane girder.

A bridge or gantry crane designed in a particularly advantageous manner in terms of construction and manufacturing technology is achieved in that the crane girder comprises at least one upper boom extending in a straight line in the longitudinal direction thereof and at least one lower boom disposed in parallel with the upper boom, wherein the upper boom and the lower boom are connected to one another via a plurality of struts disposed in the longitudinal direction of the crane girder.

In a further advantageous embodiment, provision is made for the crane to comprise two crane girders disposed in parallel and at a distance from one another.

An exemplified embodiment of the invention is explained in greater detail with reference to the drawings.

DESCRIPTION OF THE PREFERRED EMBODIMENTS

The description given below with the aid of a bridge crane also applies correspondingly for other types of cranes such as gantry cranes.

Figure 1:
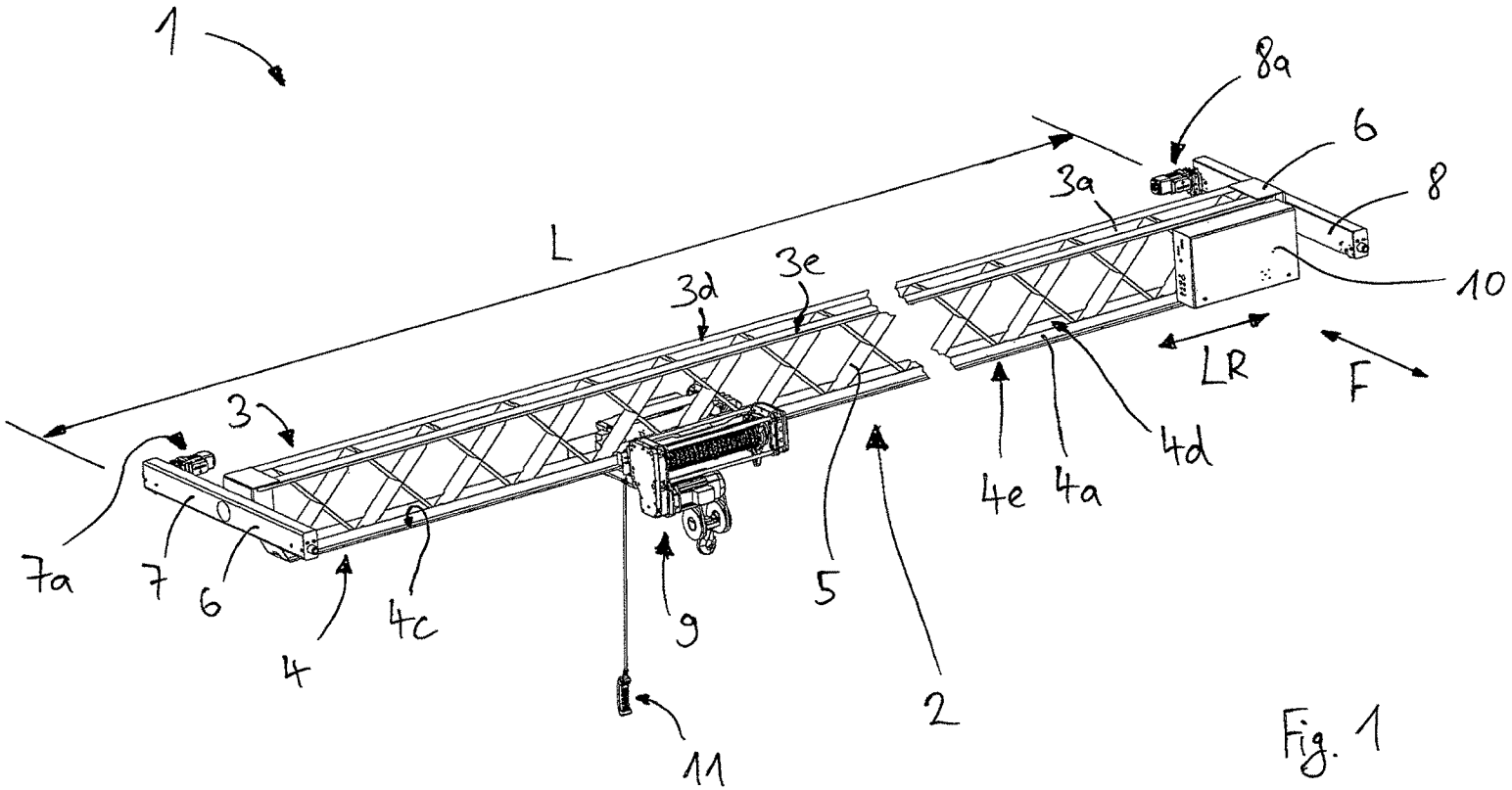
FIG. 1 shows a bridge crane formed as a single-girder crane.

FIG. 1 shows a crane 1 designed as a single-girder bridge crane. The crane 1 comprises a crane girder 2 designed as a lattice girder, oriented horizontally and extending with a length L in the longitudinal direction LR thereof.

With first and second running gear units 7, 8 attached to its mutually opposing ends, the crane girder 2 of the crane 1 forms a crane bridge which is substantially in a double T shape as seen in a plan view. By means of the running gear units 7, 8, the crane 1 can travel in a horizontal travel direction F transversely to the longitudinal direction LR of the crane girder 2 on rails, not shown. The rails are disposed raised with respect to the ground in a conventional manner and for this purpose can be elevated, e.g. via a suitable support structure, or can be attached to mutually opposing building walls. In order to move the crane 1 or the crane girder 2 thereof, the first running gear unit 7 is driven by a first electric motor 7*a* and the second running gear unit 8 is driven by a second electric motor 8*a*. A crane trolley 9 is suspended on the crane girder 2 by a hoist formed as a cable pull, said crane trolley being able to travel by means of running gear units, not shown, transversely to the travel direction F of the crane 1 and in the longitudinal direction LR of the crane girder 2. The crane trolley 9 can travel along a lower boom 4 of the crane girder 2 and on running surfaces 4*c* protruding laterally therefrom. The crane 1 additionally comprises a crane control 10 and a pendant control switch 11 connected thereto, whereby the crane 1 and the electric motors 7*a*, 8*a* and the crane trolley 9 with the cable pull can be actuated and operated separately from one another. In this connection, a load picking-up means of the cable pull disposed on the crane trolley 9 can be raised and lowered.

Figure 2:
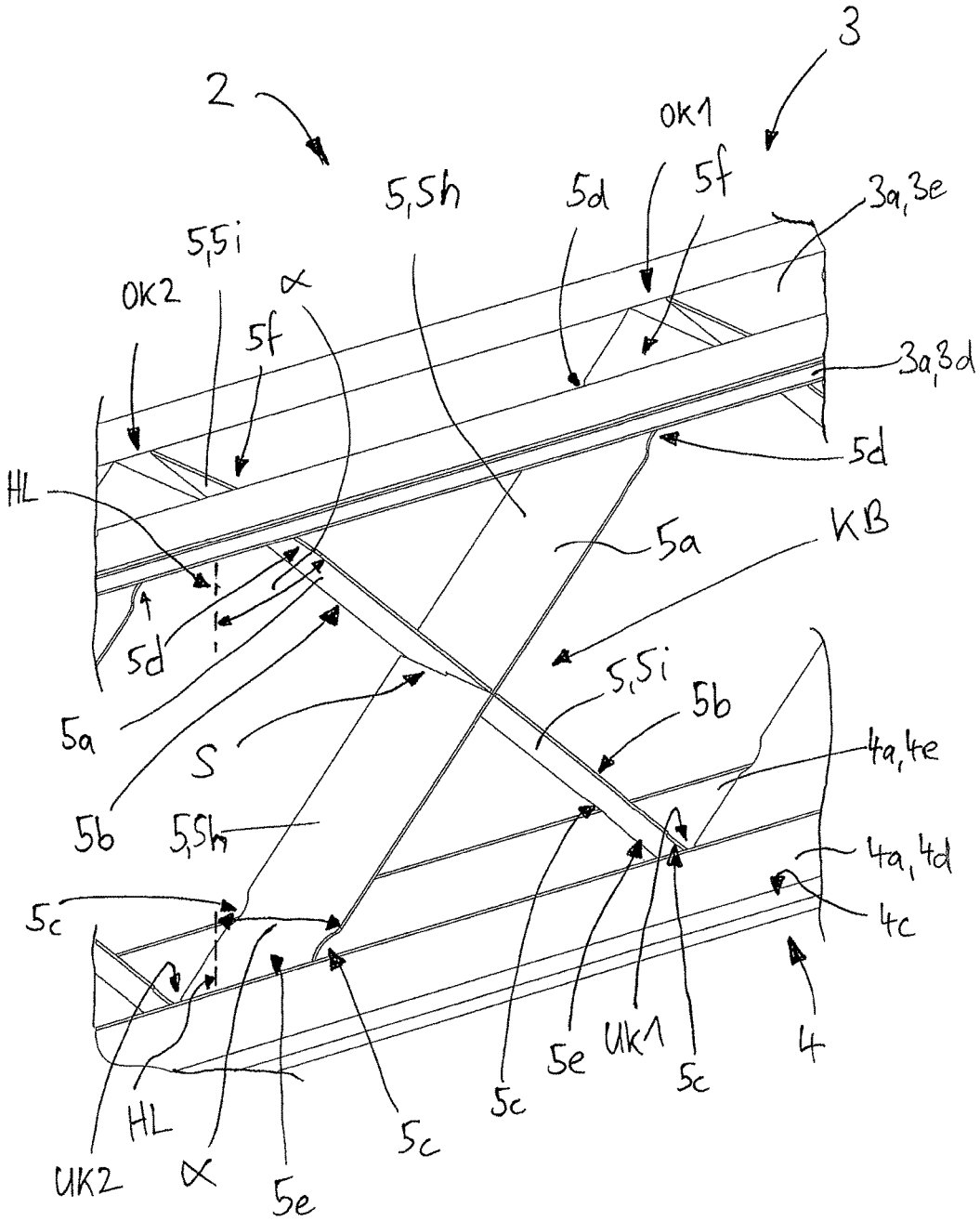
FIG. 2 shows a perspective view of a section of a crane girder in accordance with the invention for a bridge crane of FIG. 1.

FIG. 2 shows a perspective view of a section of a crane girder 2 in accordance with the invention for the crane 1 of FIG. 1. The lattice construction of the crane girder 2 essentially comprises an upper boom 3, a lower boom 4 and a plurality of struts 5 extending diagonally therebetween, via which the upper boom 3 is fixedly connected to the lower boom 4. The struts 5 have a sheetlike flat design and are formed without bent edges and are disposed in pairs in an X shape as seen transversely to the longitudinal direction LR of the crane girder 2. The X-shaped arrangement of the struts 5 and the construction of the struts 5 are explained in detail hereinunder.

In addition, the lattice construction of the crane girder 2 is attached to the opposing ends of the upper boom 3 and of the lower boom 4 in each case via an end piece 6 (see FIG. 1). By means of these end pieces 6, the upper boom 3 and the lower boom 4 are connected to form a frame. Furthermore, the running gear units 7, 8 are attached to the end pieces 6.

The upper boom 3 and the lower boom 4 each extend in a straight line, in parallel with and spaced apart from one another in the longitudinal direction LR of the crane girder 2 between the running gear units 7, 8. In this connection, the upper boom 3 and the lower boom 4 are vertically spaced apart from one another. The upper boom 3 is composed of two first and second upper boom profiles 3*d*, 3*e* which are disposed in a horizontal plane and spaced apart from one another horizontally. The two upper boom profiles 3*d*, 3*e* are each formed from an L-shaped or angular profile girder with a limb 3*a* oriented vertically downwards and a horizontal flange 3*f* disposed at a right angle thereto. The flange 3*f* of the upper boom profiles 3*d*, 3*e* preferably lie in a horizontal plane with an upper end face of the struts 5. In the same way, the lower boom is formed by two lower boom profiles 4*d*, 4*e*. The downwardly directed limbs 3*a* of the upper boom 3 and the upwardly directed limbs 4*a* of the lower boom 4 face one another. The spacing of the outermost edges of the upper boom 3 or of the lower boom 4 as seen in the longitudinal direction LR also produces a width B of the crane girder 2 (see FIG. 3). Alternatively, the lower boom 4 can also be formed by a single-piece flat profile 4*b* with two vertically upright limbs 4*a* and a horizontal flange 4*f* connecting the limbs 4*a*, so that a cross-section approximately in the form of a U-shaped profile is produced. In this connection, the flange 4*f* of the flat profile 4*b* is extended laterally beyond the limbs 4*a* (see also FIG. 3). The mutually opposing ends of the flange 4*f* of the flat profile 4*b* each form a running surface 4*c* for running gear units of the crane trolley 9. The upper boom 3 can also be fundamentally formed from a corresponding flat profile 3*b*.

Proceeding from one of the two end pieces 6, as seen in the longitudinal direction LR of the crane girder 2, a plurality of strut pairs arranged in an X shape are provided and each comprise a first strut 5*h* and a second strut 5*i*. As seen in the longitudinal direction LR, the respective paired X-shaped arrangement of struts 5 is repeated until the opposite end in the form of the other end piece 6 of the crane girder 2 is reached.

The strut pair provided with reference signs by way of example in FIG. 2 is disposed between the two ends of the crane girder 2. The first strut 5*h* of this strut pair is welded to the upper boom 3 at a first upper junction point OK1 and the second strut 5*i* is welded to the lower boom 4 at a first lower junction point UK1. The first strut 5*h* accordingly extends diagonally downwards to a second lower junction point UK2 on the lower boom 4 and the second strut 5*i* extends diagonally upwards to a second upper junction point OK2 on the upper boom 3.

Figure 4:
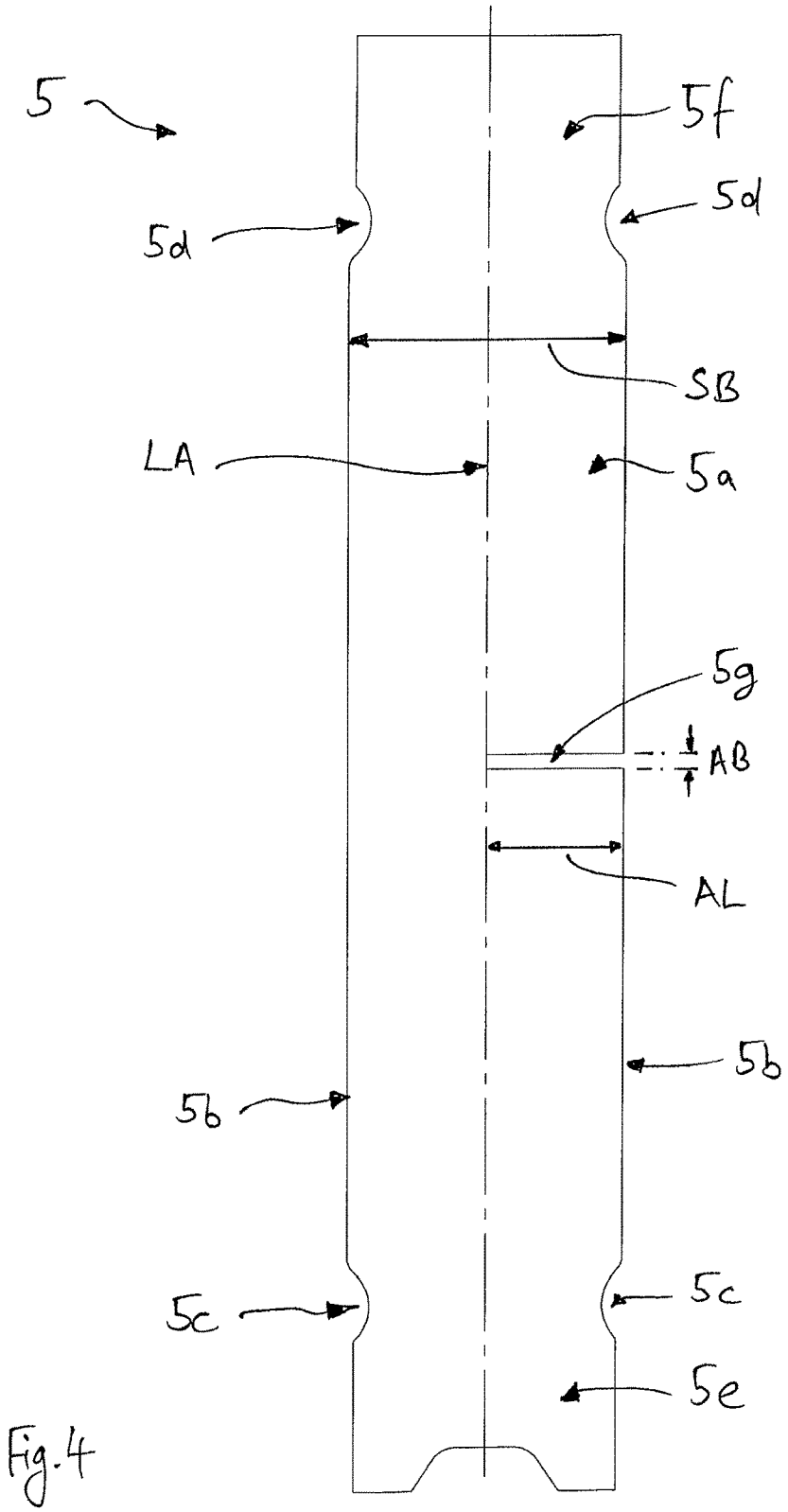
FIG. 4 shows a view of a strut of the crane girder of FIG. 2.

In order to be able to be disposed in an X shape with respect to one another and in a mutually crossing manner, the two struts 5*h* and 5*i* of each strut pair each have a slot-shaped cut-out 5*g* (see FIG. 4). By means of the cut-outs 5*g* the two struts 5*h* and 5*i* are fitted together to form a crossing region KB. In order for secure mutual support of the two struts 5*h* and 5*i* of the strut pairs to be ensured, the struts 5*h* and 5*i* can not only be fitted together but additionally be welded to one another in the crossing region KB by weld seams S extending along the two cut-outs 5*g*.

Each strut 5 is inclined at a setting angle α with respect to a notional vertical work plane which extends at a right angle to the upper boom 3 and lower boom 4 extending in parallel in the longitudinal direction LR. In this connection, the setting angle α is formed by the planar main surface 5*a* of the respective strut 5 and the work plane. For the sake of simplicity the setting angle α is marked between the main surface 5*a* and a reference line HL which lies in the work plane. The setting angle α is preferably in a range of 35° to 55° and is particularly preferably 45°. Depending on the length L of the crane girder 2 prior to assembly, the setting angle α is preferably determined such that an even number of struts 5 each of the same length and at the same setting angle α are used and all struts 5 can be disposed in an X shape in a corresponding manner.

The X-shaped arrangement of the struts 5 results in a correspondingly large number of upper junction points OK and lower junction points UK (see FIG. 1), whereby the lower boom 4 or upper boom 3 serving as a rail for the crane trolley 9 is reinforced against sagging and buckling and the crane girder 2 as a whole is stiffened and stabilised. In this way it is possible to dispense with using vertical posts in addition to the struts 5 for support purposes between the upper boom 3 and the lower boom 4.

The struts 5 are oriented within the lattice construction of the crane girder 2 in such a way that the main surface 5*a* thereof extends transversely to the longitudinal direction LR of the crane girder 2. Furthermore, the struts 5 are disposed with their lower first strut ends 5*e* between the two vertically upwardly directed limbs 4*a* of the lower boom 4. At their upper second strut ends 5*f*, the struts 5 are disposed between the two vertically downwardly directed limbs 3*a* of the upper boom 3. In this connection, the upper boom 3 lies with the inner sides of its limbs 3*a* and the lower boom 4 lies with the inner sides of its limbs 4*a* against long sides 5*b* of the struts 5 extending in parallel therewith. The struts 5 are welded to the limbs 3*a*, 4*a* along weld seams S formed at that location only in the region of their long sides 5*b* which are in corresponding contact (see FIG. 3). As seen transversely to the longitudinal direction LR of the crane girder 2, only one strut 5 is thus ever provided between the limbs 3*a*, 4*a* of the upper boom 3 or of the lower boom 4 respectively.

Figure 3:
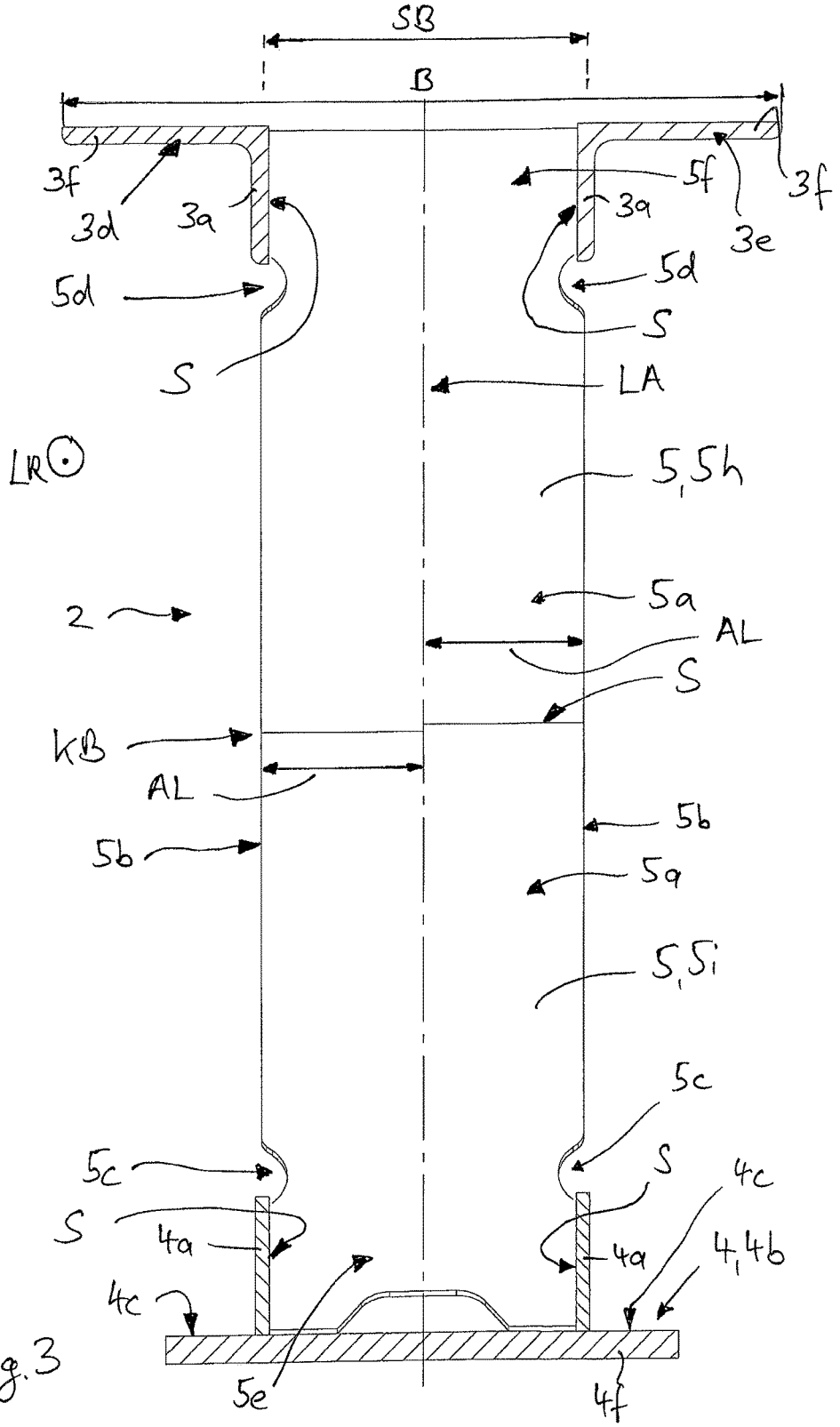
FIG. 3 shows a cross-sectional view of the crane girder of FIG. 2.

FIG. 3 shows a cross-sectional view of the crane girder 2 of FIG. 2, the cross-section of which extends vertically and transversely to the longitudinal direction LR between two adjacent strut pairs. Accordingly, FIG. 3 shows a view of a crossing region KB of the strut pair described with the aid of FIG. 2. In this connection, the upper halves of the first struts 5*h* and the lower halves of the second struts 5*i* of the strut pair, which are constructed identically to the first struts 5*h*, are illustrated, whereby the construction principle of all flat struts 5 can clearly be seen.

The struts 5 are formed as a sheet metal profile with an elongate form and a main surface 5*a* with a substantially rectangular cross-section. The struts 5 are preferably produced by laser cutting from a sheet of steel which forms the main surface 5*a*. The main surface 5*a* is substantially defined by long sides 5*b* extending in parallel with the longitudinal axis LA and extends along the longitudinal axis LA of the strut 5. At least in the middle region, the main surface 5*a* of the strut 5 with a strut width SB extends over at least half the width B of the crane girder 2 transversely to the longitudinal direction LR of the crane girder 2. The width B corresponds to the spacing between the outermost points, as seen in the longitudinal direction LR, of the lower boom 4 or—as in the case of the crane girder 2 shown in FIG. 3—of the upper boom 3, in particular of the flange 3*f*, 4*f* oriented outwards away from the longitudinal axis LA.

In the region of the mutually opposing lower first and upper second strut ends 5*e* and 5*f*, in each case a lower first recess 5*c* and an upper second recess 5*d* respectively are provided on the two long sides 5*b* of the struts 5. A narrowing of the main surface 5*a* transversely to the longitudinal axis LA is produced by the recesses 5*c*, 5*d* in the region of each strut end 5*e*, 5*f*, whereby the struts 5 each form a type of membrane joint in these regions. The first and second recesses 5*c*, 5*d* are round, preferably in the form of an arc of a circle, and, with respect to the attachment of the struts 5 to the upper boom 3 or lower boom 4 of the crane girder 2 cause the force flow through the struts 5 welded on in the region of the strut ends 5*e* and 5*f* to be optimised and the weld seams S or the associated weld seam run-outs at that location to be revealed. For this purpose, the recesses 5*c*, 5*d* are located preferably outside the limbs 3*a*, 4*a* but adjoin them.

In the view shown in FIG. 3, the slot-shaped cut-outs 5*g* of the two struts 5*h* and 5*i* are concealed and thus not illustrated. The formation of the cut-outs 5*g* is described hereinunder with the aid of FIG. 4. However, FIG. 3 already shows that the cut-outs 5*g* in the struts 5*h* and 5*i* of each strut pair are in particular formed in such a way that the struts 5*h* and 5*i* which are thereby fitted together and arranged in an X shape can be disposed with their mutually allocated long sides 5*b* in a flush arrangement. The cut-outs 5*g* of the two struts 5*h* and 5*i* each extend for this purpose from the corresponding long side 5*b* at a right angle to the long side 5*b* with a cut-out length AL approximately as far as the longitudinal axis LA. In order to be able to fit together the two struts 5*h* and 5*i* of the illustrated strut pair for the X-shaped arrangement and the formation of the crossing region KB, the struts 5*h* and 5*i* must be positioned in such a way that the cut-outs 5*g* are each disposed on mutually opposing long sides 5*b* of the struts 5*h* and 5*i*. In order to weld the struts 5*h* and 5*i* fitted together in this way, a weld seam S passing through the whole strut width SB then extends along the two cut-out lengths AL. As seen in the longitudinal direction LR, the struts 5*h* and 5*i* are preferably welded on both sides of the crossing region KB.

Furthermore, each cut-out 5*g* is central with respect to the whole strut length, i.e. disposed in the region of half the strut length on one of the two long sides 5*b*. Alternatively it is also feasible for the cut-outs 5*g* to be disposed off-centre with respect to the whole strut length and accordingly also for the crossing region KB not to be disposed half the way up the X-shaped strut pair.

Furthermore, on the lower first strut end 5*e* and/or the upper second strut end 5*f*, rectangular slots (not shown) can be provided in the main surface 5*a* in order thereby to place the struts 5 onto the limbs 3*a* and 4*a* respectively prior to welding onto the upper boom 3 and lower boom 4 respectively. It is likewise feasible for the two limbs 3*a* or the two limbs 4*a* not to be disposed at the same distance from one another and then also for the long sides 5*b* to be correspondingly spaced apart at different distances from one another in the region of the strut ends 5*e*, 5*f* in order to be able to lie against the limbs 3*a* and 4*a* respectively and be welded thereto.

FIG. 4 shows a view of a strut 5 of the crane girder 2 according to FIG. 2. In particular the central position of the cut-out 5*g* in the main surface 5*a* with respect to the whole strut length is illustrated. The cut-out 5*g* extends from one of the two long sides 5*b* substantially as a rectangle and with a cut-out width AB as far as the longitudinal axis LA. The cut-out width AB corresponds at least to the sheet metal thickness of the main surface 5*a* of the struts 5 in order to be able to receive this when they are fitted together to form a strut pair. It can also be seen that the membrane joints formed by the recesses 5*c*, 5*d* are disposed between the cut-out 5*g* and the respective strut end 5*e* or 5*f* as seen in the direction of the longitudinal axis LA, which strut end is welded between the limbs 3*a* or 4*a* in the installed state (see FIG. 3).

In the exemplified embodiment illustrated in FIGS. 1 to 4, the long sides 5*b* are formed without bent edges over their entire length and therefore over the entire strut length. Accordingly, the long sides 5*b* and the main surface 5*a* lie in a common plane spanned by the main surface 5*a* and bent edges on the long sides 5*b* to form so-called anti-buckling means are not provided.

Alternatively to the X-shaped arrangement illustrated in FIGS. 1 to 3, a different arrangement of the flat and bent edge-free struts 5 is also feasible, e.g. a paired V-shaped arrangement (not shown). In this connection the struts 5 extend freely between the upper boom 3 and the lower boom 4 and are not mutually supported as in the X-shaped arrangement. Moreover, the struts 5 then differ from the design used for the X-shaped strut pair in that they are formed with mirror symmetry with respect to their longitudinal axis LA and have no cut-outs 5*g*. In particular, the above-described membrane joints are always provided in the case of bent edge-free struts 5. However, in the case of long overall strut lengths for the bent edge-free struts 5, it is also fundamentally feasible e.g. in the case of the V-shaped arrangement of bent edge-free struts 5 that for support purposes between the upper boom 3 and the lower boom 4 in addition to the struts 5 a plurality of vertically extending posts are also provided which are arranged in the longitudinal direction LR of the crane girder 2 between individual struts 5 or strut pairs and likewise fixedly connect the upper boom 3 and the lower boom 4 to one another. The posts are preferably flat, analogously to the struts 5, and are welded to the upper boom 3 and the lower boom 4. However, in the case of short overall strut lengths for the struts 5, support by means of posts is not necessary.

Of course, the crane 1 can be designed not only as a single-girder crane but also as a dual-girder crane which then correspondingly comprises two crane girders 2 in accordance with the invention, at the ends of which in turn running gear units 7, 8 are attached in a conventional manner so that a frame is formed as seen in plan view. However, in this connection, the crane trolley 9 is not necessarily suspended on the lower booms 4 of the crane girders 2 but can also run on upper booms 3 of the two crane girders 2. Accordingly the crane trolley 9 disposed centrally between crane girders 2 can be moved in the longitudinal direction LR of the crane girder 2 and between the two crane girders 2. In this connection, the load picking-up means of the cable pull disposed on the crane trolley 9 can be raised and lowered between the two crane girders 2.

LIST OF REFERENCE SIGNS

1 crane
2 crane girder
3 upper boom
3*a* limb
3*b* flat profile
3*d* first upper boom profile
3*e* second upper boom profile
3*f* flange
4 lower boom
4*a* limb
4*b* flat profile
4*c* running surface
4*d* first lower boom profile
4*e* second lower boom profile
4*f* flange
5 strut
5*a* main surface
5*b* long side
5*c* first recess
5*d* second recess
5*e* first strut end
5*f* second strut end
5*g* cut-out
5*h* first strut
5*i* second strut
5*k* third recess
5*l* fourth recess
6 end piece
7 first running gear unit
7*a* first electric motor
8 second running gear unit
8*a* second electric motor
9 crane trolley
10 crane control
11 pendant control switch
α setting angle
AL recess length
B width
F travel direction
KB crossing region
L length
LA longitudinal axis
LR longitudinal direction
OK upper junction point OK1 first upper junction point
OK2 second upper junction point
S weld seam
SB strut width
UK lower junction point
UK1 first lower junction point
UK2 second lower junction point

The invention claimed is:

1. A crane, said crane comprising at least one horizontally extending crane girder designed as a lattice girder having a plurality of struts, on which crane girder a crane trolley with a hoist can travel, wherein at least some of the struts have a sheetlike flat design and the flat struts each comprise a planar main surface which extends in each case transversely to a longitudinal direction of the crane girder, wherein on each long side of the struts a first recess and a second recess is provided in the main surfaces, wherein the long sides are formed without bent edges by at least some of the flat struts at least between the first and second recesses.

2. The crane as claimed in claim 1, wherein the long sides are formed without bent edges over their entire length.

3. The crane as claimed in claim 2, wherein the bent edge-free long sides extend exclusively in a plane of the respective main surface.

4. The crane as claimed in 3, wherein the long sides of all struts are formed without bent edges.

5. The crane as claimed in claim 4, wherein at least one first strut and one second strut form a strut pair and are disposed in an X shape with respect to one another as seen transversely to the longitudinal direction of the crane girder.

6. The crane as claimed in claim 5, wherein the two struts of each strut pair each comprise a cut-out in one of the long sides and the two struts are fitted together by means of the two cut-outs.

7. The crane as claimed in claim 6, wherein the two struts of each strut pair are welded together in the region of the cut-outs.

8. The crane as claimed in claim 7, wherein the cut-outs in the struts of each strut pair are formed in such a way that the mutually allocated long sides of the struts arranged in an X shape are disposed in a flush arrangement.

9. The crane as claimed in claim 8, wherein the cut-outs extend starting from the respective long side in the direction of a longitudinal axis of the struts, and wherein the cut-outs extend in a rectangular shape as far as the longitudinal axis and are disposed in the region of half the strut length.

10. The crane as claimed in claim 4, wherein at least one first strut and one second strut form a strut pair and are disposed in a V shape with respect to one another as seen transversely to the longitudinal direction of the crane girder.

11. The crane as claimed in claims 1, wherein the crane girder comprises at least one upper boom extending straight in the longitudinal direction thereof and at least one lower boom disposed in parallel with the upper boom, wherein the upper boom and the lower boom are connected to one another via a plurality of struts disposed in the longitudinal direction of the crane girder.

12. The crane as claimed in claim 1, wherein the crane comprises two crane girders disposed in parallel with and spaced apart from one another.

13. The crane as claimed in claim 1, wherein the bent edge-free long sides extend exclusively in a plane of the respective main surface.

14. The crane as claimed in claim 1, wherein the long sides of all struts are formed without bent edges.

15. The crane as claimed in claim 1, wherein at least one first strut and one second strut form a strut pair and are disposed in an X shape with respect to one another as seen transversely to the longitudinal direction of the crane girder.

16. The crane as claimed in claim 15, wherein the two struts of each strut pair each comprise a cut-out in one of the long sides and the two struts are fitted together by means of the two cut-outs.

17. The crane as claimed in claim 16, wherein the two struts of each strut pair are welded together in the region of the cut-outs.

18. The crane as claimed in claim 16, wherein the cut-outs in the struts of each strut pair are formed in such a way that the mutually allocated long sides of the struts arranged in an X shape are disposed in a flush arrangement.

19. The crane as claimed in claim 16, wherein the cut-outs extend starting from the respective long side in the direction of a longitudinal axis of the struts.

20. The crane as claimed in claim 19, wherein the cut-outs extend in a rectangular shape as far as the longitudinal axis and are disposed in the region of half the strut length.

21. The crane as claimed in claim 1, wherein at least one first strut and one second strut form a strut pair and are disposed in a V shape with respect to one another as seen transversely to the longitudinal direction of the crane girder.

* * * * *